US007328539B2

(12) United States Patent
Hunt et al.

(10) Patent No.: US 7,328,539 B2
(45) Date of Patent: Feb. 12, 2008

(54) DOOR AND METHOD OF MAKING SAME

(75) Inventors: William P. Hunt, Alpine, CA (US); Brian D. Edstrom, Chula Vista, CA (US); Michael Charles Michie, San Diego, CA (US); George M. Clayton, Valley Center, CA (US); Timothy Lee McCleery, San Diego, CA (US)

(73) Assignee: JELD-WEN, inc., Klamath Falls, OR (US)

( * ) Notice: Subject to any disclaimer, the term of this patent is extended or adjusted under 35 U.S.C. 154(b) by 249 days.

(21) Appl. No.: 10/443,627

(22) Filed: May 22, 2003
(Under 37 CFR 1.47)

(65) Prior Publication Data

US 2004/0231285 A1 Nov. 25, 2004

(51) Int. Cl.
*E04C 2/38* (2006.01)
*E06B 5/16* (2006.01)

(52) U.S. Cl. ..... 52/784.15; 52/457; 52/784.1; 52/742.13; 52/309.15; 428/76; 428/192; 156/196

(58) Field of Classification Search ..... 52/455–458, 52/783.1, 784.1, 784.11, 784.14, 795.1, 742.1, 52/742.13, 309.4, 309.15, 784.15, 794.1; 264/129, 162, 319, 219, 256; 156/39, 196, 156/292, 256; 428/920–921, 71, 76, 192
See application file for complete search history.

(56) References Cited

U.S. PATENT DOCUMENTS 2,178,729 A 11/1939 Shields
2,825,674 A * 3/1958 Werner ..... 156/182
3,225,505 A * 12/1965 Lytz ..... 428/201
4,015,393 A * 4/1977 Warwick ..... 428/119
4,103,467 A * 8/1978 Lindal ..... 52/404.1
4,236,365 A * 12/1980 Wheeler ..... 52/455
4,343,127 A * 8/1982 Greve et al. ..... 52/784.11
4,602,466 A * 7/1986 Larson ..... 52/309.11
5,074,087 A 12/1991 Green
5,239,799 A * 8/1993 Bies et al. ..... 52/309.11
5,318,734 A * 6/1994 Palmersten et al. ..... 264/46.5
5,369,869 A 12/1994 Bies et al.
5,537,789 A * 7/1996 Minke et al. ..... 52/313
5,782,055 A 7/1998 Crittenden
6,092,343 A * 7/2000 West et al. ..... 52/309.11
6,132,540 A * 10/2000 Barber et al. ..... 156/78
6,485,800 B1 * 11/2002 Liittschwager et al. ..... 428/15

FOREIGN PATENT DOCUMENTS

DE 525520 C 5/1931
GB 460611 A 2/1937
WO WO 01/04448 A1 1/2001

* cited by examiner

*Primary Examiner*—Winnie Yip
(74) *Attorney, Agent, or Firm*—Nelson Mullins Riley & Scarborough LLP

(57) ABSTRACT

A door and a method for manufacturing a door are described. A door according to an embodiment of the present invention comprises a split frame, or two frames. Each split frame is attached to an inner surface of a skin and a core material is poured onto the inner surface between the stiles and rails of the frame. The resulting door section is machined to a close tolerance and combined with a complementary section to form a complete composite door.

26 Claims, 4 Drawing Sheets

DOOR AND METHOD OF MAKING SAME

NOTICE OF COPYRIGHT PROTECTION

A section of the disclosure of this patent document and its figures contain material subject to copyright protection. The copyright owner has no objection to the facsimile reproduction by anyone of the patent document, but otherwise reserves all copyrights whatsoever.

FIELD OF THE INVENTION

The present invention generally relates to doors and the manufacture thereof. The present invention more particularly relates to the manufacture of a door having a split frame.

BACKGROUND

Manufacturers of composite doors strive to create a door skin that closely resembles a real wood door. They must also strive to reduce the cost of manufacturing such a door. Manufacturers have implemented a variety of manufacturing processes to achieve these sometimes conflicting goals.

For example, U.S. Pat. No. 6,485,800 to Littschwager, et al (hereinafter "Littschwager", which is assigned to the assignee of the present application, discloses one process for manufacturing a composite door. In the process disclosed in Littschwager, the door manufacturer creates a silicone mold from an original wood door, referred to as the "plug." The manufacturer then laminates a skin on the mold. The skins may comprise various materials.

Once the manufacturer has laminated a skin, the manufacturer places a temporary frame on the inner surface of the skin. The frame comprises at least a pair of horizontal pieces, called rails, and at least a pair of vertical pieces called stiles. Typically, when the frame is placed, the manufacturer simply lays the frame down on top of the skin; however, the manufacturer may use adhesive or vacuum pressure to hold the temporary frame in place. The temporary frame acts as a dam when the core material is subsequently applied.

According to the process described in Littschwager, the manufacturer next applies the core material. The core material may comprise various materials, such as wood block, particleboard, medium density fiberboard, or urethane. The manufacturer pours the core material onto the inner surface of the skin within the temporary frame. The core material is carefully measured so that when it rises, the depth of the material will exceed the thickness of the frame. In other words, the core material extends slightly above the frame when the partially completed door is lying on the skin. A machine applies the core, using a timed pouring. For example, in one process, a ninety-second pour provides enough core material for a standard 36"×96" door to allow for expansion or rise above a one and a half inch frame.

Once the core has cured, but prior to fully cooling, the manufacturer removes the temporary frame. The remaining part, comprising a skin and core, is now ready for machining. Two of these parts are used to assemble a finished door. In a conventional one-and-three-quarter-inch-thick composite door, each part is machined to be seven eighths of an inch thick, including the one-eighth inch skin and three quarters of an inch core.

Once machining is complete, the part (skin and core combination) is removed from the mold (demolded) and placed in a medium density fiberboard (MDF) assembly tray.

The assembly tray is a mirror image or the door to be assembled. Every design element of the door is routed into the assembly board so that the skin fits firmly in place.

Final assembly of the composite door involves three components: two machined skin-core combinations and one frame. The manufacturer places a first skin-core combination on the assembly board, applies adhesive to the frame, and sets the frame on the skin-core combination. The manufacturer then applies adhesive to the other side of the frame and places another skin-core combination on top of the frame. The manufacturer then places another assembly board on top of the upper skin and applies pressure or a combination of both heat and pressure to the components to complete the assembly process.

Composite doors manufactured by the method described above as well as by other, conventional methods suffer from several disadvantages. Due to the use of the temporary frame and other factors, the manufacturer has difficulty maintaining close tolerances. As a result, the finished door may not meet quality standards. For example, composite doors manufactured using conventional methods may comprise telegraphing visible or tactile irregularities in the surface of the door. Telegraphing may be evidenced by a noticeable depression or raised area in the transition from frame to core. Since many of the conventional composite doors are prefinished with a high-gloss topcoat, any irregularities are accentuated, and therefore, the manufacturer cannot sell the door.

Also, in a conventional process for manufacturing composite doors, considerable material is wasted. For example, in a conventional one-and-three-quarter-inch composite door, the temporary frame, or dam, used to hold the core material in place on a skin while it cures is one-and-one-half-inches thick, and the core is poured to a depth greater than this temporary frame. However, the manufacturer must machine the cured core to a thickness of only three quarters of an inch in order to combine one skin-core combination with another to create the one-and-three-quarter-inch composite door. Therefore, more than half of the core material applied to each door section is wasted. In addition, it can be difficult to roll a fiberglass skin accurately.

Addressing telegraphing, also referred to as telescoping, and other quality problems resulting from conventional manufacturing methods results in much wasted time, materials, and money. Doors must be repaired in the field, reworked in the factory, or scrapped. These problems also result in increases in warranty costs as low-quality doors that are shipped to customers must be fixed or replaced. These quality problems and the measures taken to address them all serve to decrease the profitability of manufacturing the doors.

An efficient method of manufacturing a high-quality door is needed.

SUMMARY

Embodiments of the present invention comprise doors and methods of manufacturing doors. An exemplary embodiment of the present invention comprises a composite door having a pair of complementary sections attached to one another. In one embodiment, each of the sections comprises a molded skin, which forms the face panel of the completed door and a rectangular frame laminated to the skin. In another embodiment, each section includes a core material poured on the inner surface of the skin, between the stiles and rails of the rectangular frame.

In one embodiment, each section comprises one half of the total thickness of the door. To increase the strength of the attach between the pair of sections and to simplify the process of aligning the two sections, the stiles or other structure of the frames may comprise a depression, such as a groove, for accommodating a corresponding projection, such as a tongue, on the frame of the other section.

One method for manufacturing a door according to the present invention comprises making the first section, making the second corresponding section, and attaching the two sections together.

In an exemplary embodiment, a manufacturer constructs a first section by first molding a skin to form a composite face panel of the composite door. The manufacturer then adhesively laminates the skin to a rectangular frame. During the lamination, the manufacturer may vacuum press the frame to the skin. Next, the manufacturer pours a core material the volume defined between the inside surface of the skin and the inside surfaces of the stiles and the rails. The manufacturer then repeats these steps to construct a second section.

Once the manufacturer has allowed the cores to cure, the manufacturer machines the backs of the sections—the side opposite the skins—to attain a desired thickness. Preferably, the manufacturer machines each section to half of the desired thickness of a complete composite door or slightly less to account for the thickness of the adhesive. Once the sections are complete, the manufacturer attaches the two sections together to form a door. In one embodiment, the manufacturer applies pressure. In another embodiment the manufacturer applies both heat and pressure.

Embodiments of the present invention provide numerous advantages over conventional composite doors and conventional methods of manufacturing composite doors. For example, in one embodiment of the present invention, a hollow door manufacturer is able to compensate for variations in the thickness of a skin by milling each section of the frame prior to joining the sections together. Additional advantages include increases in efficiency and quality. For example, in an embodiment of the present invention, tolerances are minimized leading to enhanced quality of the finished doors. Improved quality results in a reduction in refits and remakes due to telegraphing and other imperfections in the doors. In addition returns and associated warranty costs are reduced as are the number of field repairs, internal reworks, and scrap. Minimal tolerances and reduced scrap also help to increase the yield of finished doors per quantity of input materials. Reductions in cost and increase in yields all serve to increase the profitability of the composite doors to the manufacturer.

In addition, an embodiment of the present invention may also create a stronger door. And a door according to and embodiment of the present invention is less susceptible to extremes in climate, including areas that are hot and dry, areas with high humidity, and areas that experience extreme freeze and thaw cycles.

Further details and advantages of embodiments of the present invention are set forth below.

BRIEF DESCRIPTION OF THE FIGURES

These and other features, aspects, and advantages of the present invention are better understood when the following Detailed Description is read with reference to the accompanying drawings, wherein.

DETAILED DESCRIPTION

Embodiments of the present invention comprise a door and a method of manufacturing a door. In one embodiment of the present invention, a door comprises a pair of sections attached to one another. Each section comprises a skin and a frame. In another embodiment, each section comprises a skin, a frame, and a core material present on the inside surface of the skin. In one embodiment, each section comprises one half of a door. For example, in one embodiment, a composite door that is one-and-three-quarter-inches thick comprises two sections, each having a one-eighth inch skin and a three-quarter inch frame and core. Thus the door has a "split frame."

Figure 1:
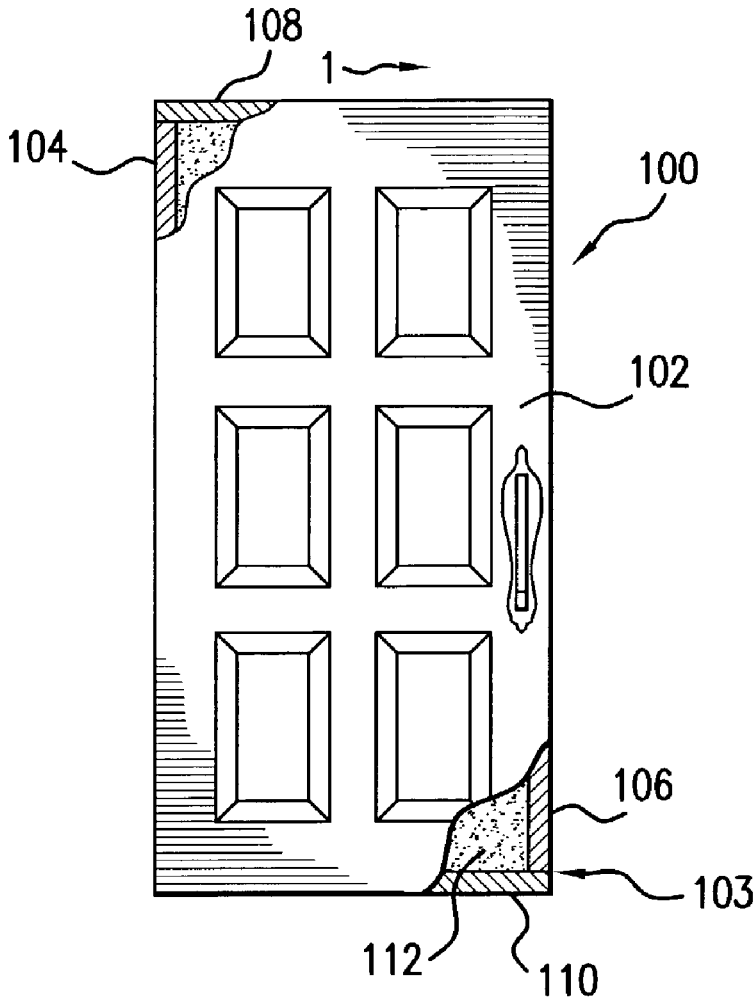
FIG. 1 is a front plan view, partially broken away, of a composite door section according to an embodiment of the present invention.

Referring now to the figures, in which like numbers indicate like elements throughout the several figures, FIG. 1 is a front plan view, partially broken away, of a section 100 of a (36"×96") door according to one embodiment of the present invention. The door section 100 comprises a skin 102. The skin 102 is attached to a frame 103, which comprises two vertical stiles 104 and 106. The frame 103 also comprises horizontal rails. One rail 108 is adjacent to the top edge of the skin 102 and extends along line 1-1. The other rail 110 is adjacent to the bottom edge of the skin 110. The door section 100 is filled with a core material 112. The core material 112 may comprise various materials, such as wood block, particleboard, medium density fiberboard, or urethane.

Figure 2:
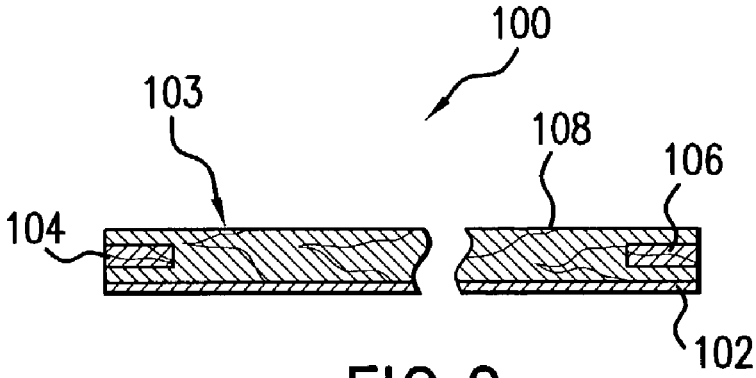
FIG. 2 is a fragmentary section view of the door section of FIG. 1 along line 1-1 in one embodiment of the present invention.

FIG. 2 is a fragmentary section view along line 1-1 of the embodiment of a composite door section 100 illustrated in FIG. 1. The composite door section 100 shown is lying with the skin 102 down. The frame, which comprises stiles 104 and 106 and rails 108 and 110, is attached to the skin 102. The core material 112 is between the stiles 104 and 106 and the rails 108 and 110 on the inner surface of the skin 102. Also illustrated in FIG. 2 are tongues 302 and 304 present on stile 106. The tongues 302 and 304 are used to align the section shown with a groove present in a second section of a finished door. In other embodiments, additional complementary tongue and groove combinations or other methods of securing and aligning the sections may be implemented.

Figure 3:
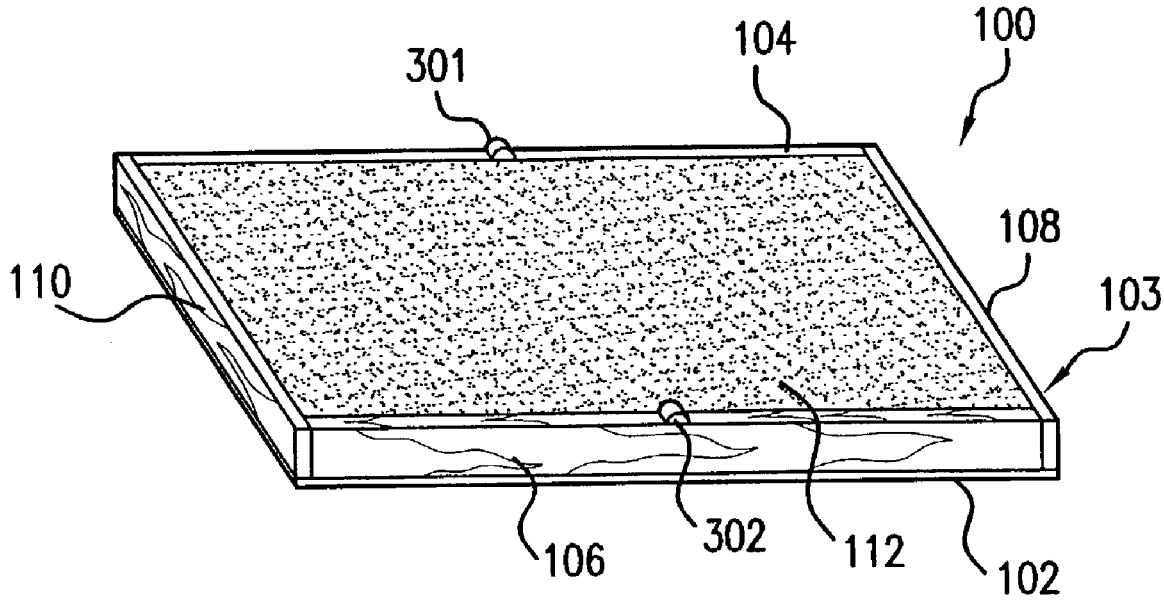
FIG. 3 is a fragmentary section perspective view of the door section of FIG. 1 in one embodiment of the present invention.

FIG. 3 is a fragmentary section perspective view of the door section 100 illustrated in FIGS. 1 and 2 in one embodiment of the present invention. In the embodiment shown, the stiles 104 and 106 are joined at the corners of the skin 102 with rails 108 and 110. The core material 112 has been poured on the inside surface of the skin 102 and within the rectangle formed by the stiles 104 and 106 and rails 108 and 110. Stiles 104 and 106 comprise a tongue 302 and 304. The tongue 302 and 304 is a protruding strip along the edge of the stile 104 and 106 or other structural element of the door section that fits into a matching groove on the edge of another stile or structural element on a second corresponding door section (not shown). The tongue 302 shown is utilized to align composite door section 100 with the corresponding door section.

Figure 4:
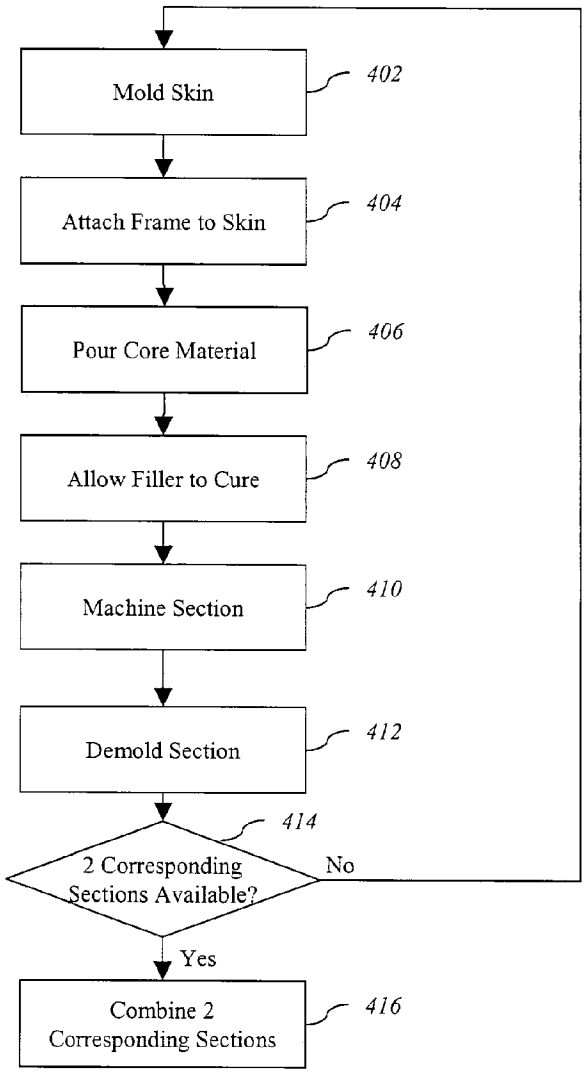
FIG. 4 is a flowchart of a process for making a door in one embodiment of the present invention.

FIG. 4 is a flowchart of a process for making a door in one embodiment of the present invention. In the process illustrated in FIG. 4, the manufacturer of a composite door molds a skin (102) 402. Using a wooden door, the manufacturer creates a mold, also referred to as a plug. The mold may comprise silicone or another suitable material. The manufacturer uses the mold to create laminated skins that resemble the surface of the wooden door, using fiberglass reinforced polyester or another suitable material.

Once the skin (102) has been molded, the manufacturer attaches a frame (103) to the skin (102) 404. In one embodiment, the manufacturer laminates the skin (102) to the frame (103) with a pliers-grip adhesive. The manufacturer uses a vacuum press to hold the frame (103) while aligning it to and attaching it with the skin (102).

Once the skin (102) and frame (103) are removed from the vacuum press, the manufacturer pours the core material onto the inner face of the skin (102) to a thickness just greater than that of the frame (103) 406. In an embodiment in which the manufacturer pours the core material, the core material must be in a liquid state when poured, such as urethane heated beyond its melting point. When the core material contacts the inner surface of the skin (102), it begins attaching with the skin (102). The manufacturer then allows the core material to cure 408. The core material preferably reaches a green tier state before it is machined. In an embodiment in which urethane is utilized as the core material, the core material typically reaches a green tier state before reaching room temperature.

Once the core material has cured, the manufacturer machines the door section (100) 410. In one embodiment, the manufacturer uses a computer numerical cutter (CNC) with a live cut insert tooling blade to machine the door section (100). The CNC essentially shaves the back of the section (100)—the side opposite the skin (102)—to a desired thickness. The CNC may also create a groove or tongue in the section (100) to simplify and improve the process of combining multiple sections to finish assembly of a composite door.

In the embodiment shown, once the section (100) has been machined, it is demolded or removed from the mold 412. In other embodiments, the section (100) is removed from the mold before machining. In the embodiment shown in FIG. 4, the demolding process completes the creation of one section (100) of a complete composite door. If the manufacturer has not yet created the second section (not shown), the manufacturer repeats steps 402-412 to create a second composite door section corresponding to the first door section (100). Preferably, the second section has the same dimensions as the first.

The manufacturer then combines the two sections 416. The manufacturer combines the sections by placing the first section (100) in an assembly tray horizontally with the skin (102) down, applying adhesive to the frame (103) and core material of the section (100), placing the second, corresponding section on top of the first section with the skin on top, aligning the sections using the tongue and groove if present, and clamping the sections together. The manufacturer may apply pressure or a combination of heat and pressure to ensure a strong attach is created between the sections.

Figure 5:
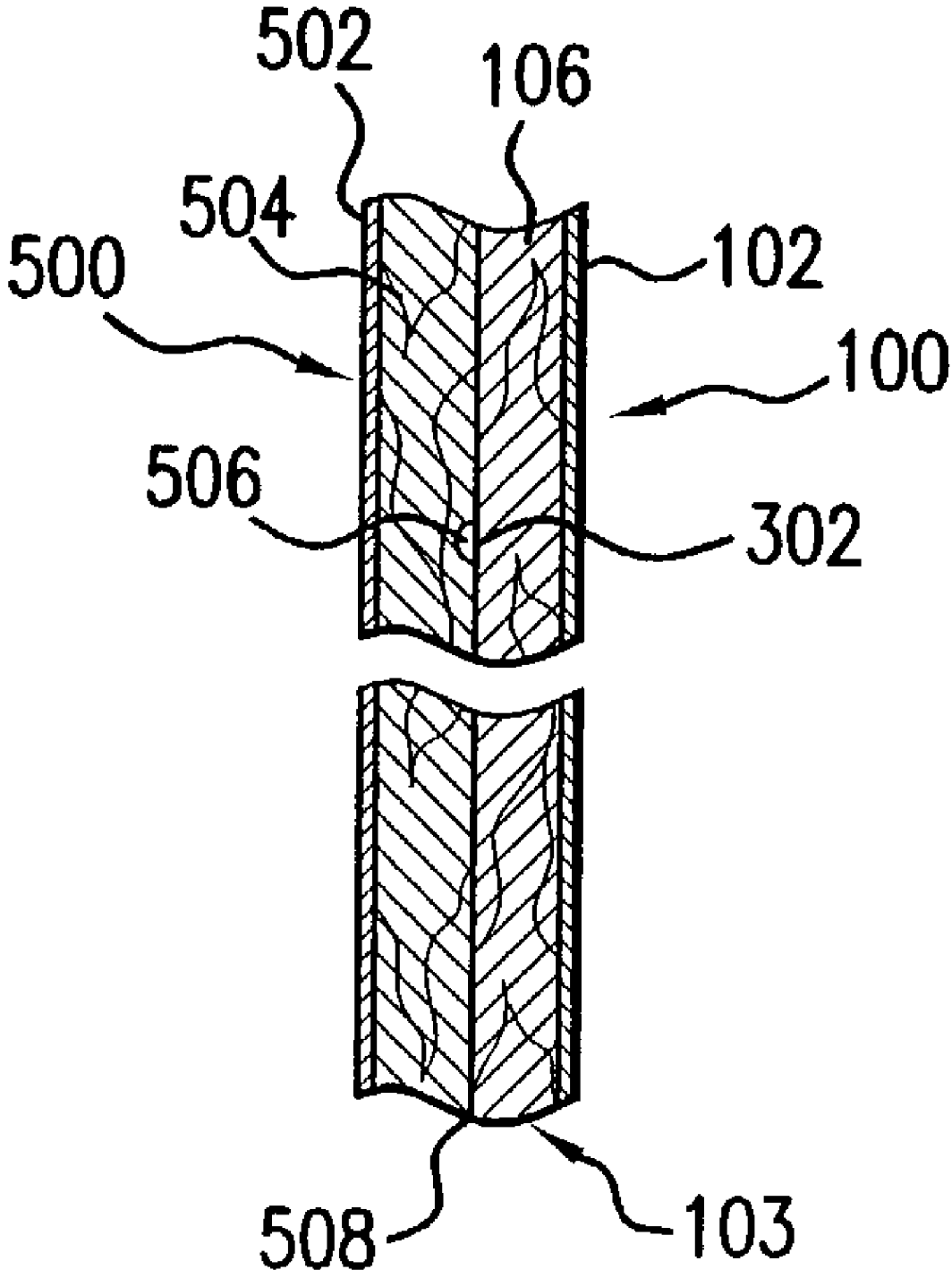
FIG. 5 is a fragmentary section view of a completed door, which comprises the door section of FIG. 1 along line 2-2 in one embodiment of the present invention.

FIG. 5 is a fragmentary section view along line 2-2 in one embodiment of the present invention, illustrating a finished composite door. The first section 100 of the door is combined with a second section 500. The second section comprises a skin 502, which is opposite of skin 102 in the finished door. The second section 500 also comprises a pair of stiles attached to the skin 502, including stile 504 and a stile (not shown) on the opposite side of the skin 502. In the embodiment shown, the first section 100 comprises a tongue 302, and the second section 500 comprises a groove 506. To combine the sections, the manufacturer applies adhesive to the stiles 104 and 504 and aligns the sections. To align the two sections 100 and 500, the tongue 302 is inserted into the groove 506, strengthening the attachment and limiting any movement while the adhesive sets. Once the sections 100 and 500 are aligned, they are compressed and may be heated as well. A door results from this process.

One embodiment of the present invention is a standard one and three quarter inch thick composite door, comprising two sections of equal thickness. In such an embodiment, each section of the finished door comprises a one eighth inch skin and a three quarter inch frame and core.

In one such embodiment, when the manufacturer produces the frame for each section, the frame is somewhat thicker than three quarters of an inch. The additional material provides a degree of flexibility during the machining process. In such an embodiment, the manufacturer pours a urethane core material to a level that is, or will be after rising, slightly thicker than the three quarter inch frame. Once the core material cures, the manufacturer machines the frame and the core material to three quarters of an inch thick, resulting in a section, including the skin, that is seven eights of an inch thick. The manufacturer combines the two sections and the resulting door is one-and-three-quarter-inches thick, preferably within plus or minus one sixteenth of an inch.

In another embodiment of the present invention, a manufacture produces a hollow door. The manufacture molds the skin. The manufacturer then attaches a frame to the skin. Once the frame has been attached to the skin, the manufacturer machines the section to a predetermined width. The manufacturer repeats the process for a second section. By machining each half separately, the manufacturer is able to compensate for any variances in the thickness of the skin or other materials used to manufacture the door.

In other embodiments, the manufacturer varies the order of the steps for manufacturing a door. For example, in one embodiment, the manufacturer molds a skin, attaches a first frame to the skin, attaches a second frame to the first frame, inserts core material, and then attaches the second skin to the second frame.

The foregoing description of the preferred embodiments of the invention has been presented only for the purpose of illustration and description and is not intended to be exhaustive or to limit the invention to the precise forms disclosed. Numerous modifications and adaptations thereof will be apparent to those skilled in the art without departing from the spirit and scope of the present invention.

That which is claimed:

1. A method of making a door, comprising:

forming a first door section comprising a first door skin attached to a first frame and a first core material provided within a volume defined by said first door skin and said first frame, said first frame comprising a first pair of stiles and a first pair of rails;

forming separately from said first door section a second door section complementary to said first door section, said second door section comprising a second door skin attached to a second frame and a second core material provided within a volume defined by said second door skin and said second frame, said second frame comprising a second pair of stiles and a second pair of rails; and attaching said first door section to said second door section, wherein said first pair of said stiles of said first door section is attached directly to said second pair of said stiles of said second door section and said first pair of said rails of said first door section is attached directly to said second pair of said rails of said second door section.

2. The method of claim 1, wherein said first pair of said stiles is disposed adjacent to the side edges of said first door skin, one of said first pair of said rails is attached to said first pair of said stiles and disposed adjacent to a top edge of said first door skin, and another one of said first pair of said rails is attached to said first pair of said stiles and to a bottom edge of said first door skin.

3. The method of claim 1, wherein said first frame is rectangular.

4. The method of claim 1, further comprising before the step of attaching said first door section to said second door section:

pouring within said first frame said first core material; and pouring within said second frame said second core material.

5. The method of claim 4, wherein said first core material is poured into the volume defined by the inside surface of said first door skin and the inside surfaces of said first pair of said stiles and said first pair of said rails to a thickness greater than that of said first frame.

6. The method of claim 5, further comprising allowing said first core material to cure before attaching said first door section to said second door section.

7. The method of claim 6, further comprising machining said first door section to a desired thickness of said first door section.

8. The method of claim 7, wherein said desired thickness of said first door section comprises one half of the total thickness of said door.

9. The method of claim 7, wherein the desired thickness of said first door section is equal to a thickness of said second door section.

10. The method of claim 9, wherein said thickness of said second door section comprises three quarters of an inch.

11. The method of claim 4, wherein said first core material comprises urethane.

12. The method of claim 1, wherein said attaching of said first frame to said first door skin comprises vacuum pressing said first frame to said first door skin.

13. The method of claim 1, wherein attaching said first formed section to said second door section comprises applying adhesive to at least one of said first pairs of stiles and rails or said second pairs of stiles and rails.

14. The method of claim 1, wherein attaching said first door section to said second door section comprises aligning a tongue in said first frame with a groove in said second frame.

15. The method of claim 1, wherein attaching said first door section to said second door section comprises applying pressure and heat to the outside surface of said first door skin and said second door skin.

16. A method of making a door, comprising:

(a) attaching a first door skin to a first frame comprising a first pair of stiles and a first pair of rails, said first door skin and said first frame defining a first volume;

(b) attaching a second door skin to a second frame comprising a second pair of stiles and a second pair of rails, said second door skin and said second frame defining a second volume;

(c) providing within said first volume a first core material and providing within said second volume a second core material; and (d) attaching said second frame directly to said first frame, wherein said first pair of said stiles of said first frame is adjacent to said second pair of said stiles of said second frame and said first pair of said rails of said first frame is adjacent to said second pair of said rails of said second pair of said second frame.

17. A door, comprising a pair of complementary door sections, each of said pair of complementary door sections comprising:

a door skin forming a face panel;

a frame attached to said door skin, wherein said frame comprises a pair of stiles and a pair of rails; and a core material provided within each of said frame and said door skin, wherein said pair of complementary door sections is attached directly together, and wherein a first pair of said stiles and rails of one complementary door section is attached directly to a second pair of said stiles and rails of another complementary door section and wherein said core material of said one complementary door section is attached directly to said core material of said another complementary door section.

18. The door of claim 17, wherein said frame comprises a rectangular frame.

19. The door of claim 17, wherein said core material is attached to an inside surface of said door skin.

20. The door of claim 19, wherein said core material is attached to inside surfaces of at least one of said pair of said stiles and one of said pair of said rails.

21. The door of claim 17, wherein a thickness of each of said pair of complementary door sections comprises one half of a thickness of said door.

22. The door of claim 17, wherein a thickness of each of said pair of complementary door sections is substantially equal.

23. The door of claim 17, wherein one of said pair of said stiles comprises a projection and another one of said pair of said stiles comprises a depression.

24. The door of claim 23, wherein said projection comprises a tongue and said depression comprises a groove.

25. A method of making a door, comprising:

forming a first door section separately from a second door section, said second door section complementary to said first door section, said first door section comprising a first core material and said second door section comprising a second core material separate from said first core material; and adhering the first door section to the second door section and said first core material to said second core material, wherein the first door section further comprises a first pair of stiles and a first pair of rails and the second door section further comprises a second pair of stiles and a second pair of rails.

26. The method of claim 1, wherein said first core material of said first door section is attached directly to said second core material of said second door section.

* * * * *

UNITED STATES PATENT AND TRADEMARK OFFICE

CERTIFICATE OF CORRECTION

PATENT NO. : 7,328,539 B2
APPLICATION NO. : 10/443627
DATED : February 12, 2008
INVENTOR(S) : William P. Hunt et al.

It is certified that error appears in the above-identified patent and that said Letters Patent is hereby corrected as shown below:

Col. 4, lines 51, 52, 64 and 65, replace the terms “302 and 304” with the terms -- 301 and 302 --.

Signed and Sealed this

Seventeenth Day of March, 2009

JOHN DOLL
*Acting Director of the United States Patent and Trademark Office*